US007309412B2

(12) United States Patent
Minevski et al.

(10) Patent No.: US 7,309,412 B2
(45) Date of Patent: Dec. 18, 2007

(54) COMPOSITIONS AND COATINGS INCLUDING QUASICRYSTALS

(75) Inventors: Zoran Minevski, The Woodlands, TX (US); Charles Tennakoon, College Station, TX (US); Carl Nelson, Bryan, TX (US); Kelvin Anderson, Flynn, TX (US); Frederick Burns, College Station, TX (US)

(73) Assignee: Lynntech, Inc., College Station, TX (US)

( * ) Notice: Subject to any disclaimer, the term of this patent is extended or adjusted under 35 U.S.C. 154(b) by 73 days.

(21) Appl. No.: 10/824,183

(22) Filed: Apr. 12, 2004

(65) Prior Publication Data

US 2004/0256236 A1 Dec. 23, 2004

Related U.S. Application Data

(60) Provisional application No. 60/462,581, filed on Apr. 11, 2003.

(51) Int. Cl.
*C25D 15/00* (2006.01)
*C25D 5/10* (2006.01)
*C25D 5/18* (2006.01)

(52) U.S. Cl. ..... 205/104; 205/109; 205/110; 205/170; 205/176

(58) Field of Classification Search ..... 205/109, 205/110, 104, 170, 176
See application file for complete search history.

(56) References Cited

U.S. PATENT DOCUMENTS 4,721,656 A 1/1988 Vance et al.
4,789,441 A * 12/1988 Foster et al. ..... 205/50
4,895,625 A * 1/1990 Thoma et al. ..... 205/109
5,204,191 A 4/1993 Dubois et al.
5,432,011 A 7/1995 DuBois et al.
5,433,978 A 7/1995 Shield et al.
5,472,920 A 12/1995 Dubois et al.
5,496,463 A 3/1996 Mori et al.
5,571,344 A 11/1996 Dubois et al.
5,593,515 A 1/1997 Masumoto et al.
5,649,282 A 7/1997 Dubois et al.

(Continued)

FOREIGN PATENT DOCUMENTS

WO WO 2004/001100 A1 12/2003

OTHER PUBLICATIONS

F. A. Lowenheim, Electroplating, mcGraw-Hill Book Co., New York, 1978, pp. 72-75, 89-91, 120-121, 194-202, 211-219.*

(Continued)

*Primary Examiner*—Susy Tsang-Foster
*Assistant Examiner*—William T. Leader
(74) *Attorney, Agent, or Firm*—Jeffrey L. Streets; Streets & Steele

(57) ABSTRACT

Composite coating compositions, composite metallic coatings derived from these compositions, and methods of forming the composite coating compositions and composite metallic coatings, wherein the compositions and coatings comprise particles of at least one quasicrystalline metal alloy and at least one elemental metal. The methods include electrocodepositing suspended quasicrystalline metal alloy particles and dissolved metal ions onto a substrate. Preferably, the substrate is disposed in an aqueous bath containing at least one dissolved metal ion species and at least one suspended quasicrystalline metal alloy powder species. The compositions and coatings enhance the wear, friction, hardness, corrosion, and non-stick characteristics of the substrate.

69 Claims, 4 Drawing Sheets

U.S. PATENT DOCUMENTS

| | | | | |
|---|---|---|---|---|
| 5,652,877 | A | 7/1997 | Dubois et al. | |
| 5,792,333 | A * | 8/1998 | Oguro et al. | 205/103 |
| 5,833,829 | A * | 11/1998 | Foster | 205/109 |
| 5,851,317 | A | 12/1998 | Biner et al. | |
| 5,888,661 | A | 3/1999 | Dubois et al. | |
| 6,103,023 | A | 8/2000 | Cyrot-Lackmann et al. | |
| 6,149,737 | A | 11/2000 | Hattori et al. | |
| 6,183,887 | B1 | 2/2001 | Dubois et al. | |
| 6,242,108 | B1 | 6/2001 | Sordelet et al. | |
| 6,254,699 | B1 | 7/2001 | Hermanek | |
| 6,254,700 | B1 | 7/2001 | Hermanek | |
| 6,331,218 | B1 | 12/2001 | Inoue et al. | |
| 6,334,911 | B2 | 1/2002 | Kita et al. | |
| 6,471,797 | B1 | 10/2002 | Kim et al. | |
| 6,749,951 | B1 * | 6/2004 | Darolia et al. | 428/615 |

OTHER PUBLICATIONS

Jean-Marie Dubois, Song Seng Kang and Yvan Massian; "Application of Quasicrystalline alloys to surface coating of soft metals"; Journal of Non-Crystalline Solids, North-Holland Physics Publishing Amsterdam, NL, vol. 153/154, 2 Feb. 2, 1993, pp. 443-445 XP000346112.

Y. Massiani, S. Ait Yaazza and J. P. Crousier; "Electrochemical behaviour of quasicrystalline alloys in corrosive solutions"; Journal of Non-Crystalline Solids, North-Holland Physics Publishing, Amsterdam, NL, vol. 159 No. 1/2, Jun. 1, 1993, pp. 92-100, XP000303730.

International Search Report, Application No. PCT/US2004/011382, International Filing Date Dec. 4, 2004., 4 sheets.

"From Non-Stick Coatings to Nanostructures—quasicrystal structures could do it all"; Phisics SRS The Synchrotron Radiation Source; pp. 26-27.

J.N. Balaraju, T.S.N. Sankara Narayanan and S.K. Seshadri; "Electroless Ni-P composite coatings"; Journal of Applied Electrochemistry 33; 807-816; 2003.

Yoshihiko Yokoyama, Tsuneo Miura, An-Pang Tsai, Akihisa Inoue and Tsuyoshi Masumoto, "Preparation of a Large $Al_{70}Pd_{20}Mn_{10}$ Single-Quasicrystal by the Czochralski Method and Its Electrical Resistivity"; Materials Transactions, JIM, vol. 33, No. 2 (1992), pp. 97 to 101.

J.M. Dubois, S.S. Kang, J. Von Stebut; "Quasicrystalline low-friction coatings"; Journal of Materials Science Letters 10 (1991) 537-541.

"Quasicrystals at home on the range"; Of Material Interest; Advanced Materials & Processes, p. 6.

Jean-Marie Dubois; "The Applied Physics of Quasicrystals"; Physica Scripta, vol. T49, 17-23, 1993.

S.S. Kang and J. M. Dubois; "Tribological Properties of quasicrystalline coatings"; J. Mater. Res., vol. 8, No. 10, Oct. 1993, pp. 2471-2481.

Jean-Marie Dubois, Song Seng Kang, and Yvan Massiani, "Application of Quasicrystalline alloys to surface coating of soft metals"; Journal of Non-Crystalline Solids, 153 & 154 (1993) 443-445 North Holland.

Jean-Marie Dubois, Song Seng Kang and Alain Perrot; "Towards applications of quasicrystals"; Materials Science and Engineering, A179/A180 (1994) 122-126.

N. Rivier; "Non-stick quasicrystalline coatings"; Section 6. Mechanical properties, theoretical; Journal of Non-Crystalline Solids 153 & 154 (1993) 4538-462 North Holland.

An-Pang Tsai, Akihisa Inoue and Tsuyoshi Masumoto; "Icosahedral, Decagonal and Amoprhous Phases in Al-Cu-M (M=Transition Metal) Systems"; Materials Transactions JIM, vol. 30, No. 9 (1989) pp. 666 to 676.

* cited by examiner 10,000x 1,000x 5,000x 10,000x

Uncoated Al-3004

Al-3004 with electrocodeposited quasicrystalline coating

COMPOSITIONS AND COATINGS INCLUDING QUASICRYSTALS

This application claims priority from U.S. patent application 60/462,581 filed on Apr. 11, 2003.

This invention was made with government support under contract numbers DAAD16-02-C-0021, DAAD16-03-P-0564, DAAD16-03-P-0163, and W911QY-04-C-0018 awarded by the Department of Defense (Army). The government has certain rights in this invention.

BACKGROUND OF THE INVENTION

1. Field of the Invention

The present invention provides composite coating compositions that include quasicrystalline metal alloys, composite metallic coatings derived from these compositions, and methods of forming these composite coating compositions and composite metallic coatings.

2. Background of the Related Art

A quasicrystal is a phase of solid matter that exhibits long-range orientational order and translational order like a crystal, but whose atoms and clusters repeat in a sequence defined by a sum of periodic functions whose periods are in an irrational ratio. Though expected on the grounds of mathematics for two or three decades, real quasicrystalline metal alloys were discovered only about ten years ago. These still partly mysterious materials have generated a considerable effort to understand their structure and investigate their fundamental properties. The definition of atom positions within a lattice that is incompatible with the translational generative symmetry of conventional crystals has received great attention. It is now best understood in the framework of the so-called high dimensional crystallography. FIG. 1 is an image of a quasicrystalline metal alloy powder at a magnification of 10,000 times.

The question of formation and stability of quasicrystals is of great fundamental importance but yet still obscure. It has been reported that stable icosahedral-type crystals may be grown by a slow solidification technique. Furthermore, the discovery of a supposedly perfectly stable icosahedral phase close to the composition $Al_{64}Cu_{24}Fe_{12}$ launched a systematic investigation of the Al—Cu-3d metal alloy systems. The $Al_{64}Cu_{24}Fe_{12}$ alloy was found to grow single crystals with either dodecahedral or icosidodecahedral morphologies. The stable decagonal phase forms in Al—Cu—Co alloys as well as in the vicinity of the composition $Al_{66}Cu_{18}Fe_8Cr_8$, growing characteristic needle-shaped deca-prismatic single crystals.

In fact, a careful study, using diffraction techniques, of the $Al_{64}Cu_{24}Fe_{12}$ single crystals demonstrated that the actual structure is not truly quasicrystalline at room temperature. It is rather that of a crystalline material with a giant unit cell that very closely resembles the quasicrystalline phases. As a matter of fact, the $Al_{64}Cu_{24}Fe_{12}$ alloy forms a rhombohedral crystal. However, these crystalline, so-called approximant phases, transform irreversibly into the corresponding true quasicrystalline phase when heated up to a temperature range of 650 to 750° C.

Surface mechanical properties of quasicrystalline metallic coatings with three different compositions: $Al_{65}Cu_{20}Fe_{15}$, $Al_{64}Cu_{18}Fe_8Cr_8$ and $Al_{67}Cu_9Fe_{10.5}Cr_{10.5}Si_3$ (atomic percent) were examined by Dubois et al. using scratch indentation tests under diamond and hard steel indenters. These metal alloy coatings were prepared by thermal spraying techniques of three types: flame spray, thermal spray, and plasma spray. The structure of the quasicrystalline metal alloys was found to be sensitive to the cooling rate achieved during preparation, e.g., melt spinning or thermal projection technique. In the case of an $Al_{64}Cu_{18}Fe_8Cr_8$ alloy, an almost pure decagonal phase or an almost pure icosahedral phase could be obtained, depending on whether a low surface velocity (12 m/s) or high surface velocity (50 m/s), respectively, of the melt spinning wheel was used.

The influence of some coating parameters such as surface roughness, thickness, hardness, and porosity on friction has also been studied. Practically no transfer layer buildup is observed on the contact surfaces of the quasicrystalline metal alloys and indenter materials. A model showing the relation between the coefficient of friction and the roughness parameter has been proposed for a steel ball indenter and is in good agreement with experimental results. A geometrical relation between the depth of a spherical tip and the applied force has also been given. Coefficients of friction of the as-cast alloys as low as 0.09 or 0.13 (measured at constant load of 20 N) were found with diamond or hard steel indenters, respectively, whereas coefficients of friction of 0.07 (with diamond indenter) or 0.19 (with steel ball indenter) were found in the case of coatings. The dynamic hardness was found to vary from 3 to 3.3 GPa for the as-cast alloys and from 1.4 to 2.4 GPa for the coatings.

The hardness of quasicrystalline metal alloys is quite high ($H \cong 9.5$ GPa) compared with hardened steel ($H=7.7$ GPa), and is comparable to that of single-crystalline silicon ($H=10.0$ GPa). The value of the modulus of elasticity for quasicrystalline metal alloys ($E \approx 140$ GPa) is again comparable to that of silicon ($E \approx 168$ GPa). The fracture toughness of quasicrystalline metal alloys (Kic=1.0 MPa m1/2) also compares well with that of silicon crystals (Kic=0.7 MPa m1/2).

When scratching with diamond indenters, Al—Cu—Fe—B and Al—Si—Cu—Fe, exhibit low ploughing type friction (respectively $\mu=0.06\pm0.005$ and $0.07\pm0.005$), very close to values found for Al—Cu—Fe. When scratching with tungsten carbide (WC) indenters it was confirmed that friction is enhanced (respectively $\mu=0.12\pm0.03$ and $0.10\pm0.05$). Over the first five passes under load of 30 N, the friction remains constant and no scratch brittleness is observed, and friction builds up rather gradually over 300 passes reaching the value of $\mu \approx 0.15$.

The oxidation of Al—Cu—Fe and Al—Pd—Mn quasicrystalline metal alloys is very similar. Both alloys have effective protection from rapid oxidation up to temperatures of 750° C. However, comparison of the Al—Cu—Fe quasicrystalline material to Al—Pd—Mn shows that the latter one is more readily oxidized. Further, above temperatures of 750° C. enrichment of Al on the surface takes place leading to slight changes in the quasicrystalline structure.

Using three analyses of the wetting phenomenon (thermodynamics, electronic, and hysteretic), it is suggested that quasicrystalline metal alloy coatings should exhibit non-stick properties. Further, it has been shown that quasicrystalline metal alloy coatings have low surface tension, and pin liquid efficiently. This low surface tension property has another important physical consequence of providing non-oxidizability.

Many quasicrystalline metal alloys are obtained by rapid solidification of a liquid melt. The procedure is similar to the production of metallic glasses, where cooling rates of 105 to 109 Kelvin per second (K/s) are necessary to avoid the nucleation of high-temperature equilibrium phases. Melt spinning is one of the techniques that permit supercooling variation of rate at the nucleation state. Here, molten alloys are squirted on to a rotating wheel, liquid is quenched at a rate of 106 K/s and the sample is obtained as ribbons a few micrometers (μm) thick and a few millimeters (mm) wide. The ribbons contain single grains of quasicrystalline material with sizes of about 1 μm across suitable only for electron diffraction characterization. Unfortunately, formation parameters are difficult to control and though single-phase quasicrystals can be produced in this manner, their reproducibility is poor.

All current methods for the production of quasicrystals (as well as of metastable alloys and glasses) are based on generating disorder at the atomic level. This is generally done by a solid-state reaction. A typical method is the multilayer deposition technique in which alternating layers of e.g. Al and Mn are deposited on a substrate, the thickness being of the order of 1000 Å. Once the multilayer with the right average composition is obtained, the sample is bombarded by high-energy ions of inert gases (e.g., $Xe^{2+}$). An amorphous, quasicrystalline or crystalline state is obtained, depending on the energy of the ions and the sample temperature. Here, disorder is introduced by the kinetic energy of the ions and is also driven by the temperature of the multilayer sample, since atoms become more mobile as the temperature increases. Single quasicrystalline phases can be obtained in this manner, but the samples are quite small (2×2 $mm^2$ and 1000 Å thick).

Mechanical alloying is another method to produce amorphous, quasicrystalline or crystalline states. Powders of different elements are alloyed by the kinetic energy of balls vibrating in a steel container. Two other techniques used are the evaporation technique and the laser or electron melting of thin layers. In the former method, a fog of small droplets of liquid alloy is produced, and quenched. Various external shapes and structures are obtained, with typical sizes in the range of 500 to 3000 Å. Conventional casting (i.e., slow cooling from the melt) has also been employed to obtain a stable quasicrystalline state, at least in some composition and temperature range.

Despite the interesting set of physical properties exhibited by quasicrystalline metal alloys, these materials have not found their way into many commercial applications due in large part to the difficulty and expense of forming quasicrystalline metal alloy components or coatings. While plasma sprayed quasicrystalline metal alloy coatings have been used, with limited success, to form a non-stick surface on cookware, the commercial production of this cookware has ceased. FIG. 2 is an SEM image of a quasicrystalline metal alloy coating after plasma deposition onto a substrate. As shown, the severe process conditions of the plasma spray have altered the form of the quasicrystals and formed a non-uniform coating.

Therefore, there is a need for a method of forming a coating composition that exhibits the same physical properties, such as high wear resistance and low friction, as a single quasicrystalline metal alloy material. It would be desirable if the coating composition could be formed on a substrate as a metallic coating. It would be even more desirable if the method could form uniform and adherent coatings having various desired thicknesses. Still further, it would be beneficial if the coating composition and metallic coating derived from it could be formed economically under processing conditions that are compatible with the use of various substrates and applications.

SUMMARY OF THE INVENTION

One embodiment of the invention provides a method comprising electrocodepositing particles of at least one quasicrystalline metal alloy and at least one elemental metal onto a working electrode disposed in an electroplating bath, wherein the electroplating bath comprises a solvent, ions of the at least one elemental metal dissolved in the solvent, and the particles of at least one quasicrystalline metal alloy suspended in the solvent. The working electrode has an electronically conducting surface, such as a material selected from metals, alloys, graphite, carbon-carbon composites, and combinations thereof. The at least one elemental metal is preferably selected from manganese, iron, cobalt, chromium, nickel, copper, zinc, and combinations thereof. The electroplating bath is preferably selected from an electrolytic deposition bath, an electroless deposition bath, and mixtures thereof. The temperature of the electroplating bath during the electrocodeposition should not exceed the melting point of the particles of the at least one quasicrystalline metal alloy or the melting point of the working electrode, but preferably the temperature of the electrocodeposition bath during the electrocodeposition will not exceed 100° C., most preferably between 10 and 70° C. Optionally, the working electrode is a substrate selected from copper, aluminum, an alloy of aluminum, carbon or graphite, cast iron, wrought iron, carbon steels, stainless steels, copper/tin alloys, copper/zinc alloys, copper/nickel alloys, doped or undoped semiconductors, polymers, polymer composites, polymer/carbon composites, polymer/graphite composites, polymer/metal composites, and metal/metal composites.

The quasicrystalline metal alloys may include aluminum-transition metal alloys, such as those selected from Al—Cu-M, Al—Pd-M and combinations thereof, where M is a transition metal selected from Fe, Ru, Ni, Mn, Cr, Co and combinations thereof. Examples of such a quasicrystalline metal alloy include $Al_{65}Cu_{25}Fe_{12}$, $Al_{66}Cu_{18}Fe_8Cr_8$, $Al_{59}Cu_{25.5}Fe_{12.5}B_3$, $Al_{64}Cu_{18}Fe_8Cr_8$, $Al_{65}Cu_{23}Fe_{12}$, $Al_{70}Cu_{10}Fe_{10}Cr_{10}$ and combinations thereof. The quasicrystalline metal alloys may also include titanium-based quasicrystalline metal alloys; any of the ternary, quaternary and higher alloys; and quasicrystalline metal alloys that include B, Si or combinations thereof. Preferably, the electroplating bath comprises between 25 and 150 grams of one or more of these quasicrystalline metal alloy particles per liter of the electroplating bath. The electroplating bath is preferably agitated to suspend the quasicrystalline metal alloy particles. The particles preferably have an average particle size less than 50 microns, and more preferably less than 20 microns.

It is also preferred for the electroplating bath to have a dissolved metal ion concentration between 500 and 20,000 ppm. The dissolved metal ions are most preferably in the form of a metal sulfate, metal sulfamate, metal citrate, metal chloride, metal bromide, metal nitrate, or combinations thereof. For example, the electroplating bath may comprise between 2 and 12 grams of nickel sulfate per liter of the electroplating bath. The electroplating bath may further comprise a reducing agent, a buffering agent, or a combination thereof. Exemplary buffering agent may be selected from hypophosphite, formaldehyde, acetate, citrate, boric acid, and combinations thereof. The electroplating bath is preferably maintained at a pH between 2 and 7, most preferably by adding aqueous $K_2CO_3$ or $H_2SO_4$ to the bath.

The methods may include applying an electroless or electrolytic strike on the working electrode prior to the electrocodepositing step, for example wherein the strike comprises a metal selected from zinc, nickel, copper, platinum, cobalt, gold and combinations thereof.

The electrocodeposition preferably includes applying a direct current between the working electrode and the counter electrode at a potential of between 1.5 and 7 volts, or at a current density to the working electrode between 2 and 100 $mA/cm^2$, such as a target current density of about 40 $mA/cm^2$. Optionally, short-cycle ramping of a DC current can be used for the electrocodeposition, for example in cycles between $10^{-2}$ and $10^5$ Hertz. Other current control schemes, such as constant current, may also be used. Uniformity of the coating may be improved by moving at least one electrode during the electrocodeposition. Optionally, a metal seal layer may be electroplated over a layer comprising the electrocodeposited quasicrystalline metal alloy particles, most preferably using a separate seal bath. One embodiment includes alternating the use of the seal bath and the electrocodeposition bath. A counter electrode may comprise iron, cobalt, nickel, copper, zinc, platinized titanium, or ruthenium/iridium oxide-coated titanium metal, or a combination thereof.

The method preferably also includes annealing the particles of the at least one quasicrystalline metal alloy either prior to codeposition, after codeposition, or both before and after codeposition. The quasicrystalline metal alloys may be annealed at a temperature between 500 and 700° C., optionally under an inert gas atmosphere.

Other embodiments of the invention provide the coated working electrode or substrate prepared by the methods described above.

A preferred coating composition, comprises between 25 and 90 percent by mass, and more preferably between 40 and 60 percent by mass, of particles of at least one quasicrystalline metal alloy within a metal matrix including at least one elemental metal. The particles preferably have an average effective diameter of less than 40 microns, most preferably less than 20 microns. The at least one elemental metal is preferably selected from nickel, copper, and combinations thereof. The at least one quasicrystalline metal alloy is preferably selected from $Al_{65}Cu_{25}Fe_{12}$, $Al_{66}Cu_{18}Fe_8Cr_8$, $Al_{59}Cu_{25.5}Fe_{12.5}B_3$, $Al_{64}Cu_{18}Fe_8Cr_8$, $Al_{70}Cu_{10}Fe_{10}Cr_{10}$, and combinations thereof, but may include any other quasicrystalline metal alloy including titanium-based alloys. Optionally, a metal seal layer may be deposited over the metal matrix. The metal matrix may be formed with a thickness less than 40 μm.

Embodiments of the invention include a composition comprising particles of at least one quasicrystalline metal alloy within a metal matrix including at least one elemental metal, wherein the composition is characterized by a hardness greater than 6 GPa, a coefficient of friction less than 0.2, and a contact angle greater than 100 degrees. The composition may be further characterized by tiling of the particles of quasicrystalline metal alloys, a hardness between 6 and 10 GPa, an XRD spectra substantially the same as the XRD spectra produced by the bulk quasicrystalline material, a coefficient of friction that is less than 0.1 or even less than 0.05, or a contact angle greater than 110 degrees.

BRIEF DESCRIPTION OF THE DRAWINGS

So that the above recited features and advantages of the present invention can be understood in detail, a more particular description of the invention, briefly summarized above, is provided in reference to the embodiments thereof, which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENTS

The present invention provides a composite coating composition comprising at least one quasicrystalline metal alloy material and a method of forming the coating composition, where the coating composition exhibits essentially the same chemical and physical properties, such as oxidation resistance, corrosion resistance, high wear resistance and low friction, as for quasicrystalline metal alloy coatings alone. The composite coating composition comprises at least one quasicrystalline metal alloy material and at least one elemental metal.

In one embodiment, the composite coating composition comprises particles of at least one quasicrystalline metal alloy, where the particles are tightly packed or "tiled" together. The method of forming the composite coating composition comprises electrocodepositing particles of at least one quasicrystalline metal alloy within a matrix of at least one elemental metal. The electrodeposited elemental metal matrix may have an amorphous or polycrystalline structure. Where the metal matrix comprises more than one electrodeposited metal, amorphous or polycrystalline structures associated with the individual metals or alloys containing the metals may be present.

Figure 1:
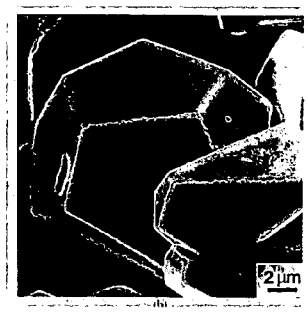
FIG. 1 is an SEM image of a quasicrystalline metal alloy powder at a magnification of 10,000×.
Figure 2:
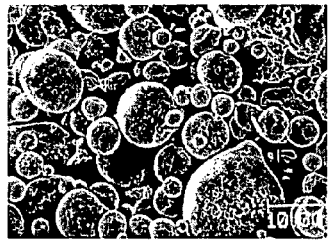
FIG. 2 is an SEM image of quasicrystalline metal alloy particles after plasma deposition onto a substrate at a magnification of 1,000×.
Figure 3A:
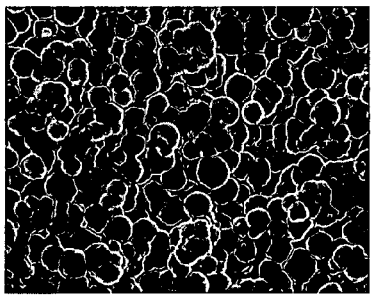
FIGS. 3A-C are images of an electrocodeposited composite metallic coating containing quasicrystalline metal alloy particles or grains at magnifications of 1,000×, 5,000× and 10,000×, respectively, on an aluminum 3004 coupon.
Figure 3B:
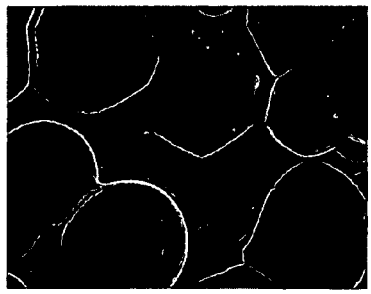
Figure 3C:
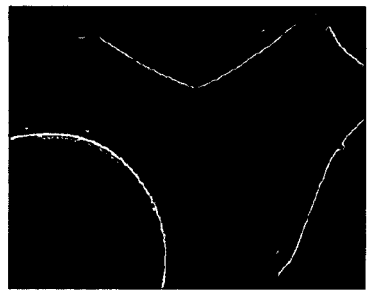
Figure 4A:
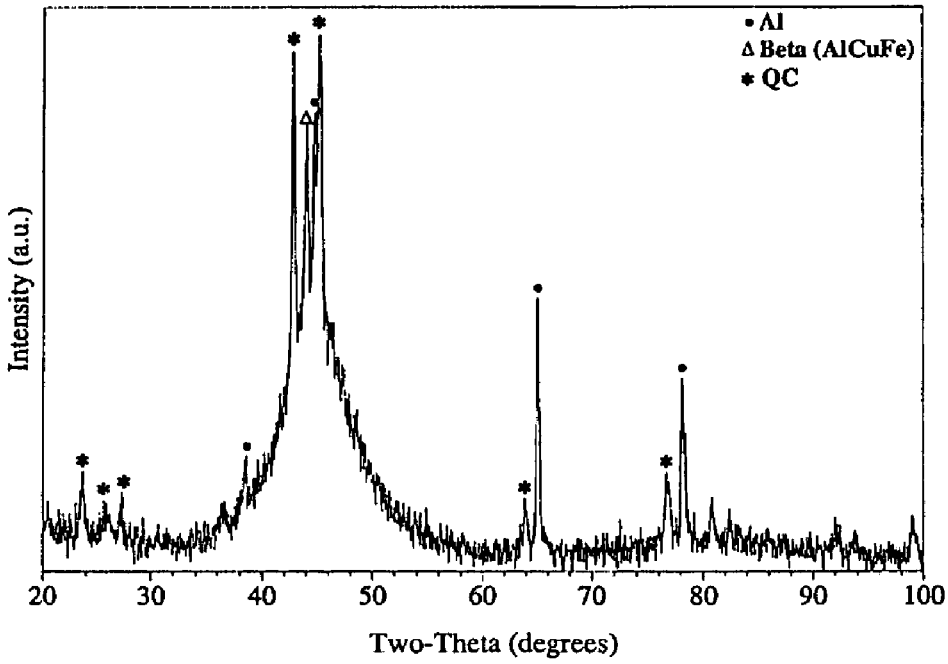
FIGS. 4A-B are X-Ray Diffraction (XRD) patterns obtained from a composite metallic coating containing quasicrystalline metal alloy particles or grains that was electrocodeposited on the surface of a 3304 aluminum alloy substrate and quasicrystalline metal alloy powder, respectively.
Figure 4B:
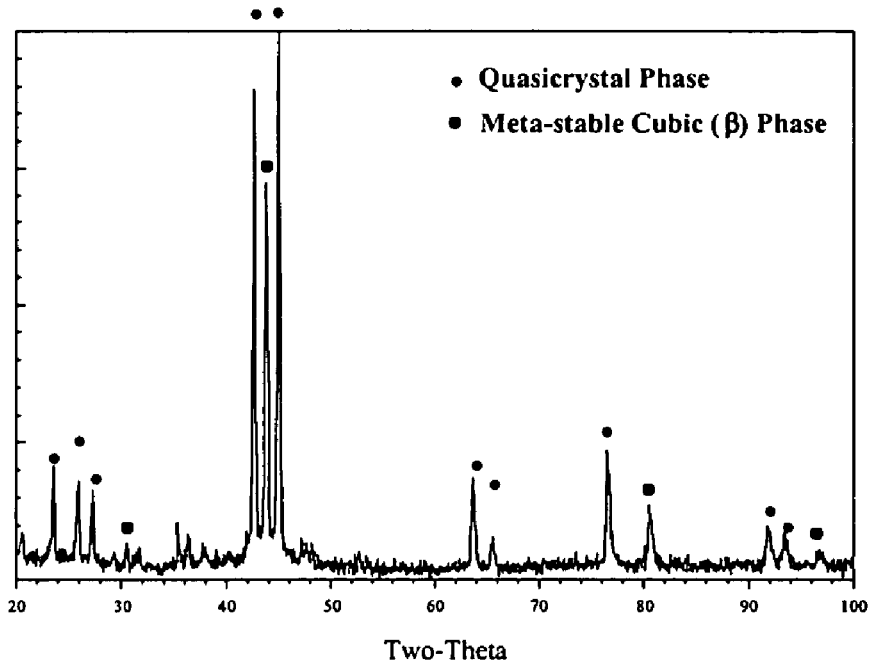

FIGS. 3A-C are images of an electrocodeposited composite coating of the present invention at magnifications of 1,000×, 5,000×, and 10,000× respectively. Here, the composite coating comprises particles of a quasicrystalline metal alloy held within a matrix of an elemental metal. The images presented in FIGS. 3A-C of the composite coating electrocodeposited on an aluminum 3004 coupon exhibit "tiling". As used herein, the term "tiling" or "tiled" refers to a close-packed arrangement or organization of particles of a quasicrystalline metal alloy with an elemental matrix between the particles. Quasicrystalline metal alloy particles deposited using thermal projection techniques, such as plasma spraying or an oxygen-gas torch, are not "tiled," but rather are deposited from the molten state in a random, overlapping, coalesced fashion over a surface.

One embodiment of the present invention provides a composite metallic coating that comprises particles of at least one quasicrystalline metal alloy material and a preferred method of forming the composite coating on a substrate. This method can be advantageously performed to produce uniform and well-adhered coatings having a desired thickness. Still further, this method allows the composite coating to be produced economically under processing conditions that are compatible with a variety of substrates and applications. A preferred method of forming the composite coating comprises electrocodepositing particles, such as a grains or powders, of at least one quasicrystalline metal alloy together with a matrix of at least one elemental metal onto an electronically conducting substrate.

In a preferred embodiment, the substrate is disposed as the cathodic working electrode in a solution comprising at least one dissolved elemental metal species in ionic form and particles of at least one quasicrystalline metal alloy suspended in the same solution. The dissolved elemental metal species is typically a metal cation, such as $Mn^{2+}$, $Fe^{2+}$, $Co^{2+}$, $Ni^{2+}$, $Cu^{2+}$, or $Zn^{2+}$, which may be complexed with another chemical added to the solution. The solution is preferably an aqueous electrolyte bath typically used for the electroplating of an elemental metal, such as manganese, iron, cobalt, chromium, nickel, copper, or zinc, or a binary or ternary alloy comprising two or more of these elemental metals, and the electronically conducting substrate serves as the cathode within the bath. A nickel electroplating bath is preferred. However, the solution can also be a mixed aqueous/non-aqueous electrolyte bath, or even a non-aqueous electrolyte bath comprising at least one organic solvent.

In one embodiment, an electroplating bath is used to electrocodeposit a composite coating comprising quasicrystalline metal alloy particles within a metal matrix, and a separate electroplating "seal bath" is used to "seal" the electrocodeposited composite coating with a layer of elemental metal. The electroplating "seal bath" is preferably an aqueous electroplating bath typically used for the electroplating of an elemental metal, such as manganese, iron, cobalt, nickel, copper, or zinc, or a binary or ternary alloy comprising two or more of these elemental metals. The codeposition electroplating bath and the "seal" electroplating bath may be used alternatingly with a given substrate to build up a coating of a desired thickness. In an alternative embodiment, the operating conditions within a single codeposition electroplating bath are altered over time to produce layers having differing compositions.

A preferred embodiment of the present invention provides new, low-cost quasicrystalline metal alloy-based composite coatings for metallic substrates and other electronically conducting substrates, such as electronically conducting polymers. Attractive features of these quasicrystalline metal alloy-based composite coatings include dramatic improvements in wear resistance, corrosion protection, oxidation resistance, reduced friction, hardness and non-stick characteristics. Additionally, when formed by electrocodeposition, the composite coatings may be formed on substrates having complex geometries, whereas quasicrystalline metal alloy coatings formed by plasma spray or other thermal projection techniques suffer from line-of-sight limitations. The electrocodeposition techniques of the present invention are suitable for large scale manufacturing of coated parts. Further still, the electrocodeposited quasicrystalline metal alloy composite coatings exhibit good adhesion to substrates, thereby allowing manufactured components to be bent without suffering delamination of the composite coatings.

Substrates that are suitable for use in the electrocodeposition process include any substrate that can be used as a cathode (working electrode) or any substrate modified for use as a cathode. To serve as a cathode, the substrate, a coating on the substrate, or a surface treatment must be electronically conductive, although the degree of electronic conductivity is not determinative. In general, the preferred substrates are elemental metals, binary, ternary, or higher order metal alloys, electronically conducting polymers and electronically conducting composites of all kinds. Specific examples of suitable substrates, without limitation, include copper, aluminum, an alloy of aluminum, carbon or graphite, cast iron, wrought iron, carbon steels, stainless steels, copper/tin alloys, copper/zinc alloys, copper/nickel alloys, doped or undoped semiconductors (e.g., silicon, gallium arsenide, or indium phosphide), polymer/carbon composites, polymer/graphite composites, polymer/metal composites, and metal/metal composites.

Substrates are preferably cleaned before receiving a pre-coat, if desired, or undergoing electrocodeposition. For example, metal substrates (elemental metals or metal alloys) are preferably prepared by bead blasting to yield a freshly exposed surface, degreasing in a commercial degreaser for 2-10 minutes at 30-80° C., and etching in a deoxidizer for 2-10 minutes at ambient temperature. The metal substrate should be thoroughly rinsed in pure water, such as 1 Mega Ohm (or better quality) deionized water following each step. The substrate may be pre-coated with an electroless or electrolytically applied metal coating, such as a strike of zinc, nickel, copper, platinum, cobalt or gold. Best results for aluminum alloy 3004 included an electroless zincate process, giving rise to an ultra thin zinc metal layer, followed with an electroless copper coat. A pre-coat, surfactant, additive conditioner, or combination thereof may optionally be used to enhance the subsequent electrocodeposition on an electronically conducting substrate. In order to allow subsequent electrocodeposition on an electronically nonconducting substrate, it is necessary to apply a metallic pre-coat.

The substrate prepared above subsequently acts as a cathode in an aqueous, mixed aqueous/non-aqueous, or a non-aqueous electrocodeposition plating bath containing dissolved elemental metals (e.g., Cr, Mn, Fe, Co, Ni, Cu, Zn) and optionally elemental non-metals (e.g., boron, B, phosphorous, P, or silicon, Si) in solution individually, or as mixtures, preferably with a total dissolved metals concentration between 500 and 20,000 ppm. Optionally, the dissolved metals may be in the form of a metal sulfate, metal sulfamate, metal chloride, metal citrate, metal bromide, metal nitrate, or combinations thereof. For example, the dissolved metal complex may be nickel chloride, nickel sulfate, nickel citrate, or copper sulfamate. Furthermore, it is most preferred that the dissolved metals include at least a small volume fraction (e.g., about 1 percent by volume) of a dissolved metal like Cu. Electrocodeposition was carried out on an aluminum 3004 alloy substrate with 5.8 grams per liter (g/L) nickel (as sulfate). Optionally, additives may be beneficially used, such as surface active, reducing or buffering agents in the electrocodeposition bath. For example, suitable additives may include surfactants, hypophosphite, formaldehyde, acetate, citrate, borate, and any combinations thereof. Preferred surfactants include cationic surfactants. Once formed, the electrocodeposition bath is agitated sufficiently to uniformly suspend quasicrystalline metal alloy particles, grains, or powders (such as $Al_{65}Cu_{25}Fe_{12}$, $Al_{66}Cu_{18}Fe_8Cr_8$, $Al_{59}Cu_{25.5}Fe_{12.5}B_3$, $Al_{64}Cu_{18}Fe_8Cr_8$, etc.) in the slurry. Preferably, the quasicrystalline metal alloy particles have a particle size in terms of an effective diameter of less than 40 microns, or less than 20 microns, or even less than 10 microns. It is also preferable to provide the quasicrystalline metal alloy particles at a concentration between 25 and 150 grams of quasicrystalline particles per liter of electroplating bath solution. It is believed that the use of finer particles will increase the packing fraction of the quasicrystalline metal alloy particles or grains in the coatings.

The coating compositions, composite coatings and processes described herein may utilize any quasicrystalline metal alloy composition, typically in the form of a powder or fine particulate. Examples of suitable quasicrystalline metal alloy compositions are described in U.S. Pat. Nos. 5,204,191; 5,432,011; 5,433,978; 5,472,920; and 6,183,887, which patents are incorporated by reference herein. For example, the quasicrystalline metal alloy materials may comprise aluminum-transition metal alloys, including Al—Cu-M and Al—Pd-M, where M is a transition metal such as Fe, Ru, Ni, Mn, Cr, or Co, and other ternary, quaternary and higher alloys having stoichiometries providing quasicrystalline structures. A small amount (typically up to about 10 atomic percent) of a transition metal, such as Ti, V, Cr, Mn, Co, Ni, Ta, W, Nb, Mo and Zr or, alternately or in addition, a small amount of boron (B) or silicon (Si) can be provided in the aforementioned Al—Cu-M and Al—Pd-M alloys to form quaternary and higher alloys without loss of quasicrystalline phase. For example, a small amount (e.g., up to about 10 atomic percent) of chromium (Cr) can be added to the Al—Cu—Fe alloy while maintaining the quasicrystalline phase. However, the amount of transition metal included will be dependent on its affect on the quasicrystalline structure. The term "quasicrystal" or "quasicrystalline metal alloy," as used herein, encompasses quasicrystalline phases in the strict sense as well as the approximant phases or compounds, such as the icosahedral phase, decagonal phase, rhombohedral phase, orthothombic O2 and O3 phases, cubic phase, hexagonal phase and other phases presently known or discovered in the future. Quasicrystalline phases in the strict sense are phases which have symmetries of rotation that are normally incompatible with the symmetry of translation, that is to say symmetries with an axis of rotation of order 5, 8, 10 and 12.

While the foregoing discussion focuses on Al-based quasicrystalline metal alloys, the present invention includes the use of other quasicrystalline metal alloys that are now known or that will be developed or discovered in the future. In particular, the invention may beneficially include quasicrystalline metal alloys from the class of titanium-3d transition metal and titanium-zirconium-3d transition metal alloys which constitute the second largest alloy class of quasicrystals. Specific examples includes Ti—Zr—Fe and Ti—Zr—Ni alloys, such as $Ti_{45}Zr_{38}Ni_{17}$.

The quasicrystalline metal alloy particles may be used "as received" from a supplier or the particles may be processed to remove any oxide formed on the surface. Because aluminum is the predominant metal in many of the quasicrystalline alloys, these quasicrystalline alloys are not easily plated. Without being limited to any particular theory, the quasicryalline alloy particles may act more as an impurity particle that becomes incorporated into the metal layer as it is electroplated. Accordingly, the electrocodeposition process described in this application may include some degree of an electrophoretic deposition or attraction process. However, it may be beneficial to partially or fully coat quasicrystalline metal alloy particles with a metal layer, for example with nickel or copper, such as in an electroless nickel or electroless copper bath, prior to electrocodepositing the particles onto a substrate.

It is also possible to use mixtures of different quasicrystalline metal alloy particles or mixtures of quasicrystalline metal alloy particles with other metal alloy particles having different compositions. These mixtures may provide the coating with a combination of desirable properties. Composite coatings with widely different compositions and properties can be deposited by varying the composition of the alloy particles or percentages of several alloy particles suspended in the electroplating bath.

The pH of the electrocodeposition bath is preferably maintained at a pH between about 2 and about 7, while the best results for an aluminum 3004 substrate were obtained with the bath pH maintained between 4.2 and 4.6. While the pH may be maintained in various ways known in the art, the preferred method of maintaining pH is with drop wise additions of 10 wt % aqueous $K_2CO_3$ or $H_2SO_4$.

The temperature of the electrocodeposition bath may be any effective temperature, but will typically be less than the boiling point of the solvent and must be maintained below the melting point of the quasicrystalline metal alloy particles. Preferably, the bath temperature is maintained between 10° C. and 70° C., although the best results for an aluminum substrate were obtained with the bath temperature between 20 and 50° C.

The substrate (cathode) is disposed in the electrocodeposition bath containing suspended powdered quasicrystalline metal alloy particles. The substrate may be held stationary or rotated, such as at a speed between 1 and 10 rotations per minute (rpm). For example, the anode may be rotated around a stationary cathode to facilitate attraction and electrocodeposition of quasicrystalline metal alloy particles onto the substrate. Further, the cathode and anode may both remain generally stationary, with either electrode periodically re-positioned to aid coverage of the cathode surface with quasicrystalline metal alloy particles. In one embodiment, the cathode substrate is rotated while positioned within a stationary cylindrical anode. Further still, electrochemical codeposition of coatings may occur simultaneously on opposing surfaces of an electronically conductive substrate or a nonconductive substrate that has been coated with a conductive layer, such as the conductive layer formed by electroless nickel or electroless copper, using two counter electrodes positioned adjacent the opposed surfaces. For example, an electrochemical coating can be applied to both internal and external surfaces of a tube or pipe by placing a first counter electrode, preferably circular, on the inside and a second counter electrode, preferably annular, around the outside of the pipe. It should be recognized that the anode may be flat or curved, and the anode is preferably made of solid or expanded iron, cobalt, nickel, copper, zinc, platinized titanium, or ruthenium/iridium oxide-coated titanium metal. The ratio of total immersed anode surface area to the cathode surface area (piece to be coated) is preferably fixed between 0.25 and 4.

Preferably, a direct current is applied between the substrate (cathode) and an anode, preferably yielding a current density ranging from 2 to 100 mA $cm^{-2}$ based on the area of the substrate immersed in the plating bath or solution for a period between 5 and 90 minutes. Alternatively, an electrical potential of between 1.5 and 7 volts is applied to give a current density of between 2 and 100 $mA/cm^2$ for a period of between 5 and 90 minutes. It should be recognized that the thickness of the coatings can be varied by controlling the current density and the deposition time. This ability to control the thickness and uniformity of the electrocodeposited layers is enhanced by the prior deposition of an electroless nickel or electroless copper undercoat on the surface of the substrate, in particular when the substrate is aluminum or an alloy of aluminum.

In accordance with an optional embodiment of the invention, after a thin quasicrystalline metal alloy particle-containing layer has been electrocodeposited on the substrate, as described above, the quasicrystalline metal alloy particle-containing layer is strengthened by electroplating an additional iron, cobalt, nickel, copper, zinc, nickel/copper, or other metal or mixed metal "seal" layer over the deposit, typically using a separate electroplating bath. The composition of the "seal" bath, or overlay bath, can be identical in composition and materials to the previously described quasicrystalline metal alloy particles-containing bath, excluding the quasicrystalline metal alloy particles, or the bath may contain an elemental metal or mixture of elemental metals divergent from the original electrocodeposition bath.

A preferred "seal"/overlay electroplating bath has a pH between about 2 and about 7, and a temperature maintained between 15° C. and 70° C. The bath is preferably agitated to facilitate plating and gas removal from the cathode. For forming a composite quasicrystalline metal alloy coating on aluminum alloy 3004, the most preferred pH of the "seal" bath is between pH 4.0 and 4.6.

The procedure of alternating between plating the substrate in a quasicrystalline metal alloy particle-containing electrocodeposition bath and in a "seal" electroplating bath may be repeated until the desired thickness of the composite quasicrystalline metal alloy coating is obtained. At this point, a final "seal" layer is applied in the "seal" electroplating bath, for example at an average current density of 25 $mA/cm^2$ for an additional 15 to 25 minutes.

In another embodiment of the invention, a substrate is coated with a composite coating comprising a quasicrystalline metal alloy material in the above mentioned electrocodeposition bath by short-cycle ramping of the DC current, as opposed to constant current mode as described above. In this variation of the procedure, the DC power supply is controlled to repeatedly ramp the current from essentially zero current, up to a target current density, such as 40 $mA/cm^2$, and back down to zero amps in cycles that range in frequency from $10^{-2}$ to $10^5$ Hertz. Intermediate and final "seal" elemental metal-rich layers alternating with composite quasicrystalline metal alloy rich layers may be formed in this manner without requiring multiple baths and steps, since increasing the current density of electrodeposition increases the deposition of the elemental metal, such as nickel, and reducing the current density facilitates the incorporation of a higher percentage of quasicrystalline metal alloy particles for any given quasicrystalline metal alloy powder concentration in the plating bath.

In a further preferred embodiment, the as-received quasicrystalline metal alloy particles are annealed prior to electrocodeposition onto a substrate. The primary advantage of annealing the quasicrystalline metal alloy particles before electrocodeposition is that the annealing can be performed at temperatures that exceed the substrate melting point (the melting point of aluminum is about 660° C.), so that a more complete conversion of any metastable quasicrystalline compliment to the stable phase quasicrystalline material can be accomplished.

Additionally, annealing coupons that have already been coated with an electrocodeposited quasicrystalline metal alloy coating as described herein will convert any decagonal (β) metastable phase compliment of the quasicrystalline metal alloy in the coating to the normal, stable phase. The coating is preferably annealed in an oxygen-free (Argon) atmosphere by heating to a temperature above 400° C. (such as between 400 and 500° C.), holding this temperature for 1 to 24 hours, and then allowing the composite coating to cool to an ambient temperature.

The coating compositions and composite coatings of the preferred embodiments of the present invention may be used in a large number and variety of applications due to the surprising physical properties that are exhibited, namely high wear resistance, low friction, and poor wetting characteristics. Furthermore, the electrodeposition methods that may be used to form the coating compositions and composite coatings can be performed economically under moderate processing conditions and without line-of-sight limitations inherent in plasma spray and other thermal projection techniques. Nonlimiting examples of applications or components that might benefit from incorporating these coating compositions or composite coatings include anti-galling coatings (such as on screw threads), pneumatic and hydraulic rams and seals, bearings and seats for bearings, engine pistons, piston rings, or cylinders (that operate below about 500-600° C.), piston-type pumps, compressor surfaces, drilling and cutting tools and equipment for industrial and machine shop applications (such as drill bits), pipelines for gaseous and liquid hydrocarbon transmission, water pipes, microfluidic channels, and cookware. Other and further applications for the invention will become apparent to those having skill in the art upon realization of the fantastic physical properties of these electrocodeposited composite coatings.

Table 1 summarizes certain physical properties and cost of manufacturing that are important in a cookware surface for a variety of materials including the electrocodeposited composite quasicrystalline metal alloy materials of the present invention. The electrocodeposited composite quasicrystalline metal alloy coatings exhibit a unique set of properties and advantages that are not provided by the other materials.

TABLE 1

| Cookware Substrate and/or Coating | Nonstick Characteristics | Durability | Staining and Corrosion Resistance | Cost |
|---|---|---|---|---|
| PTFE Coating | Very good | Poor | Very good | Low |
| Aluminum Substrate | Poor | Medium | Poor | Low |
| Anodized Aluminum Coating | Medium | Medium | Medium | Medium |
| Stainless Steel Substrate | Medium | Very good | Medium | Medium |
| Plasma Deposited Quasicrystalline Metal Alloy Coating | Medium | Medium | Medium | High |
| Electrocodeposited Composite Quasicrystalline Metal Alloy Coating | Very good | Very good | Very good | Low |

EXAMPLE 1

Electrocodepositon of a Composite Coating Incorporating a Quasicrystalline Metal Alloy Material and Nickel Metal A substrate having the dimensions 2 inches by 1 inch by 0.03 inches thick made of alloy 3004 aluminum was prepared by bead blasting to white metal, degreased in a commercial degreaser for 5 minutes at 60° C., etched in a deoxidizer for 5 minutes at ambient temperature, electroless zincated for 75 seconds, and finally an electroless copper strike was applied for 15 seconds. The substrate was thoroughly rinsed in 15 MegaOhm deionized water following each of these steps. Final loading of the precoat was 0.27 mg zinc/$cm^2$ and 0.12 mg Cu/$cm^2$.

An aqueous electroplating bath containing nickel sulfate (5.8 grams nickel/L) and sodium hypophosphite was agitated sufficiently to uniformly suspend less than 20 micron particle size $Al_{65}Cu_{23}Fe_{12}$ quasicrystalline metal alloy particles (77 g per liter). The pH of the solution was between 4.62 and 3.95. The temperature of the bath was maintained at between 47 and 50° C. A flat, stationary anode of platinized expanded titanium metal with 50% open area across its face was used and with a total immersed surface area equal to the surface area of the substrate. The substrate was suspended in the bath and served as the cathode. The substrate was rotated at 3 rpm and a direct current of 600 mA was applied for 5 minutes, 400 mA for another 5 minutes, and finally 300 mA for 5 minutes.

EXAMPLE 2

Electrocodepositon of a Composite Coating Incorporating a Quasicrystalline Metal Alloy Material and Nickel Metal and Including the Use of a "Seal" Bath A substrate having the dimensions 2 inches by 1 inch by 0.03 inches thick made of alloy 3004 aluminum was prepared by bead blasting to white metal, degreased in a commercial degreaser for 5 minutes at 60° C., etched in a deoxidizer for 5 minutes at ambient temperature, electroless zincated for 75 seconds, and finally an electroless copper strike was applied for 15 seconds. The substrate was thoroughly rinsed in 15 MegaOhm deionized water following each of these steps. Final loading of the precoat was 0.27 mg zinc/$cm^2$ and 0.12 mg Cu/$cm^2$.

An aqueous electroplating bath containing nickel sulfate (5.8 grams nickel/L in aqueous solution) was agitated sufficiently to uniformly suspend less than 20 micron particle size $Al_{65}Cu_{23}Fe_{12}$ quasicrystalline metal alloy material (40 g per liter). The pH of the solution was maintained at 4.62 with drop wise additions of 10 wt % aqueous $K_2CO_3$ to increase the pH or $H_2SO_4$ to reduce the pH. The temperature of the bath was maintained at 33° C. A flat, stationary anode was provided by platinized expanded titanium metal with 50% open area across its face and with a total immersed surface area equal to the surface area of the substrate. The substrate was suspended in the bath and served as the cathode. The substrate was rotated at 3 rpm and a direct current of 500 mA was applied for 52 minutes. For the next 20 minutes the substrate was not rotated and the current was held constant at 500 mA. Next the sample was rotated at 3 rpm and the current was held constant at 700 mA for 5 minutes. The sample was then placed in a nickel "seal" bath that was identical to the quasicrystalline metal alloy particle-containing bath except for the absence of any quasicrystalline metal alloy particles. The sample was rotated at 3 rpm, held in the bath for 2 minutes at 57° C., and the current was held constant at 350 mA. Finally, the current was increased to 500 mA and the substrate remained in the "seal" bath for 15 minutes.

The thickness of the composite quasicrystalline metal alloy material-nickel metal coating obtained was determined by SEM microprobe analysis to be about 25 microns. Quasicrystalline metal alloy material content of the coating was determined to be 50 percent of the coating volume.

Figure 5A:
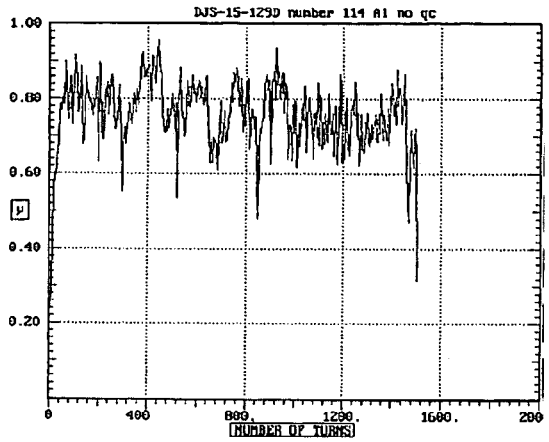
FIGS. 5A-B are graphs of friction measurements from an uncoated aluminum 3004 alloy substrate and an electrocodeposited composite metallic coating containing quasicrystalline metal alloy particles or grains, respectively.
Figure 5B:
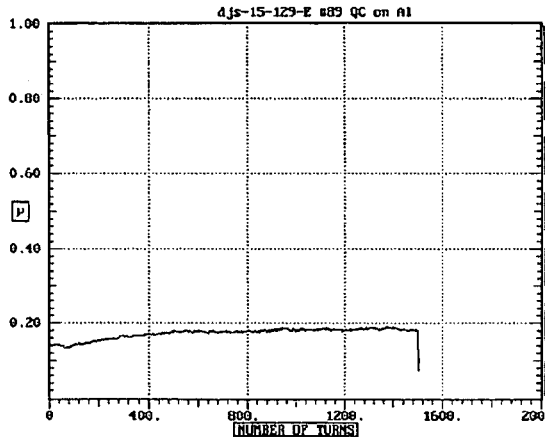

FIGS. 5A-B are graphs of pin-on-disk friction measurements from the electrocodeposited composite quasicrystalline metal alloy material-nickel metal coating and an uncoated Al-3004 substrate. The measurements on the quasicrystalline metal alloy-containing composite coating indicated a coefficient of friction of less than 0.2 and no measurable scar after 120 minutes. Bare aluminum alloy 3004 showed a coefficient of friction of between 0.75 and 0.85 and severe damage after just ten minutes on the wear tester. Published coefficients of friction of thermally applied quasicrystalline metal alloy coatings are on the order of 0.4 to 0.5. The contact angle of sessile water droplets showed the electrocodeposited quasicrystalline metal alloy-containing composite coating on the aluminum substrate to have a contact angle greater than 105 degrees.

EXAMPLE 3

Annealing a Composite Coated Substrate where the Composite Incorporates a Quasicrystalline Metal Alloy Material Substrates coated with a quasicrystalline metal alloy-containing composite coating in accordance with Example 1 were annealed by heating them in an oxygen free (Argon) atmosphere, in a sealed quartz tube, to a temperature of 425° C., held at this temperature for four hours, and allowed to cool to ambient (cooling not controlled). The annealed quasicrystalline metal alloy-containing composite coatings retained their surface energy properties as shown by a sessile water droplet contact angle measurement of 104.9 degrees. Also, the annealed composite-coated substrates retained low coefficients of friction ($\mu$=0.25) and good wear characteristics during pin-on-disk tests (passed 10 minutes of testing with no measurable scar).

EXAMPLE 4

Addition of Copper to "Seal" Bath/Addition of Copper to Quasicrystalline Metal Alloy Particles-Containing Electrocodeposition Bath Addition of 660 ppm copper to the electrodeposition "seal" bath for the plating of alloy 3004 aluminum substrates by the procedure in Example 2 (all other conditions were the same), resulted in a coating having an even higher contact angle measurement ($\mu$=105.5 degrees). It was observed that the adherence of the copper-treated quasicrystalline metal alloy-containing composite coating was increased as evidenced by the elimination of the delamination that had been occasionally encountered during "sealing" without copper. The addition of copper to the bath containing quasicrystalline metal alloy particles also improved the success of coating a substrate in that the overall coverage of the substrate with a composite coating containing quasicrystalline metal alloy particles was more rapidly obtained in the plating cycle and the composite coating coverage was more complete and uniform. It is expected that the ductility and thermal transfer of the composite coatings will also increase with elemental copper metal content of the composite coating.

EXAMPLE 5

Annealing Quasicrystalline Metal Alloy Powder Before Use in Electrocodeposition Plating Bath $Al_{65}Cu_{25}Fe_{12}$ quasicrystalline metal alloy powder was annealed for six hours at 700° C. in an argon (oxygen free) atmosphere prior to electrocodeposition on an aluminum 3004 substrate in order to achieve a more complete conversion of the metastable quasicrystalline compliment to the stable phase quasicrystalline material without having to heat the aluminum substrate beyond its melting point of 660° C. The upper limit to the quasicrystalline metal alloy powder annealing temperature is its melting point of about 1100° C. The Al-3004 substrate was plated in accordance with the procedure in Example 3, but using 260 ppm copper in an aqueous bath containing the annealed quasicrystalline metal alloy particles and nickel sulfate (as further described in Example 1). The composite coated substrate was then temperature cycled from ambient to 375° C. for 44 hours every hour.

A second Al-3004 substrate was electrocodeposited with a quasicrystalline metal alloy-containing composite coating under similar conditions except that the aqueous bath contained no copper and there was no annealing of either the composite-coated substrate or the quasicrystalline metal alloy powder particles.

Figure 6:
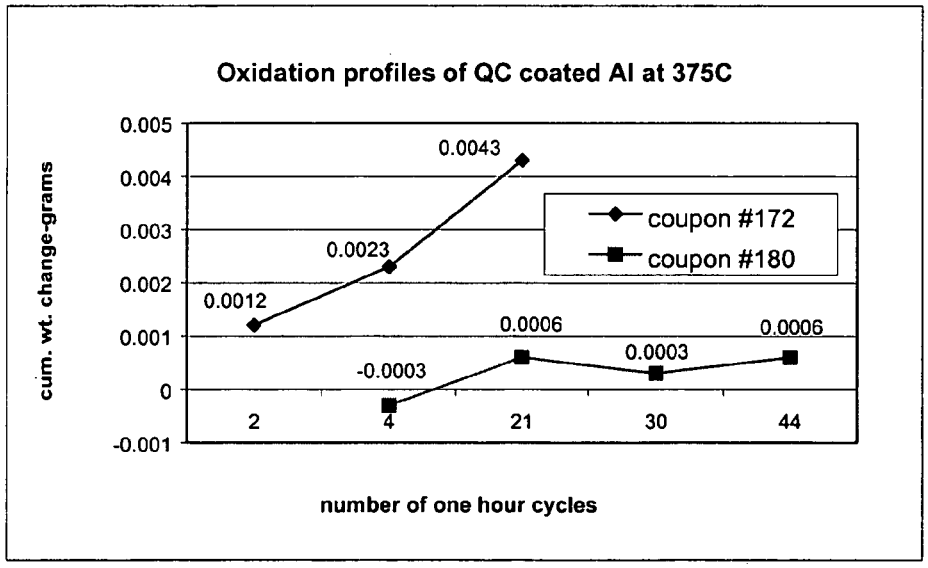
FIG. 6 is an oxidation profile of annealed and non-annealed composite metallic coatings containing quasicrystalline metal alloy particles or grains.

FIG. 6 compares the oxidation profiles of the substrate having annealed quasicrystalline metal alloy powder particles and copper (substrate #1) against the substrate without annealing or copper (substrate #2). The weight gain of substrate #2 indicates oxygen attack of the coating surface, while the profile of substrate #1 indicates a much more stable coating in respect to oxidation in high temperature air. The oxygen attack on substrate #2 was accompanied with a rainbow iridescent appearance, while the color of substrate #1 was unchanged with increased exposure time.

The average contact angles of sessile water droplets were measured after temperature cycling of these two substrates, and were found to be 91.3 (±4) degrees for substrate #2, and 117.2 (±1) degrees for substrate #1. A total of six readings were taken across the diameters of each coupon. The higher contact angle and greater consistency of the readings for substrate #1 indicate a more uniform coating that retains a high free surface energy even after repeated 375° C. temperature cycling.

EXAMPLE 6

Addition of Boron- and Chromium-containing Quasicrystalline Metal Alloy Particles to a Plating Bath Quasicrystalline metal alloy materials containing boron and chromium were electrocodeposited onto a substrate to determine if they would enhance favorable characteristics such as wear resistance, slickness, increased oxidation resistance, etc.

The use of an electrocodeposition bath ($NiSO_4$ solution with 20 grams of $[Al_{65}Cu_{23}Fe_{12}]$ quasicrystalline metal alloy material and with 10 grams of chromium-containing quasicrystalline metal alloy material) and utilizing a "seal" bath spiked with $Cu^{2+}$ ions increased the amount of composite quasicrystalline metal alloy material that was plated onto the substrate. As was the case in Example 3 above earlier, more complete coating coverage was attained with copper in the "seal" coats. An Al-3004 coupon was treated in a plating bath consisting of suspended chromium-containing quasicrystalline metal alloy powder and dissolved nickel sulfate ($NiSO_4$), and sealed with 1000 ppm $Cu^{2+}$ in a nickel sulfate-containing "seal" bath. After annealing, this coupon demonstrated friction data with μ less than 0.05.

EXAMPLE 7

Passivated Composite Coating Surface Containing Electrocodeposited Quasicrystalline Metal Alloy $[Al_{65}Cu_{23}Fe_{12}]$ Particles An Al-3004 coupon was electrocodeposited with less than 20 micron size particles of quasicrystalline $Al_{65}Cu_{23}Fe_{12}$ (40 g/L) in an aqueous (5.8 grams of nickel/L) nickel bath and alternately sealed with an aqueous (5.8 grams nickel/L) nickel/copper "seal" bath containing 667 ppm copper, under the same conditions as Example 2 above.

The coupon was then annealed at 385° C. for 24 hours under an oxygen atmosphere. The coupon had mild surface oxidation—a "rainbow" iridescent appearance that looked like a thin layer under optical microscopic observation. Subsequent testing of this coupon after annealing showed good wear characteristics (no measurable scar after 10 minutes) and a coefficient of friction well below 0.05.

EXAMPLE 8

Electrocodeposited Coating Adhesion Test

Aluminum 3004 coupons were electrocodeposited with quasicrystalline metal alloy material in accordance with Example 1. The coated coupons were then bent to a 90° angle, straightened to 180° (flat), and then re-bent to an angle of 70°. No delamination occurred, showing that electrocodeposited composite coatings containing quasicrystalline metal alloy particles can tolerate mechanical stress.

TABLE 2

Contact Angle Values for Various Coated and Uncoated Substrates.

| Substrate or Coated Substrate | Contact Angle θ (degrees) | | | | | | Average |
|---|---|---|---|---|---|---|---|
| Bare Aluminum | 78.5 | 78.6 | 85.0 | 83.4 | 94.9 | 94.8 | 85.87 |
| Nickel-coated Aluminum | 91.9 | 90.4 | 97.6 | 97.3 | 92.5 | 93.3 | 93.83 |
| Polytetra-fluoroethylene | 94.4 | 95.1 | 98.0 | 97.8 | 95.5 | 95.9 | 96.12 |
| Quasicrystalline metal alloy composite-coated Aluminum (Example 3) | 98.9 | 100.0 | 113.3 | 113.6 | 101.6 | 102.0 | 104.90 |
| Quasicrystalline metal alloy composite-coated Aluminum (Example 4) | 104.3 | 104.1 | 105.8 | 104.0 | 107.5 | 107.6 | 105.55 |
| Quasicrystalline metal alloy composite-coated Aluminum-annealed (Example 5) | 117.6 | 118.1 | 118.1 | 117.2 | 116.0 | 116.2 | 117.2 |

EXAMPLE 9

Figure 7A:
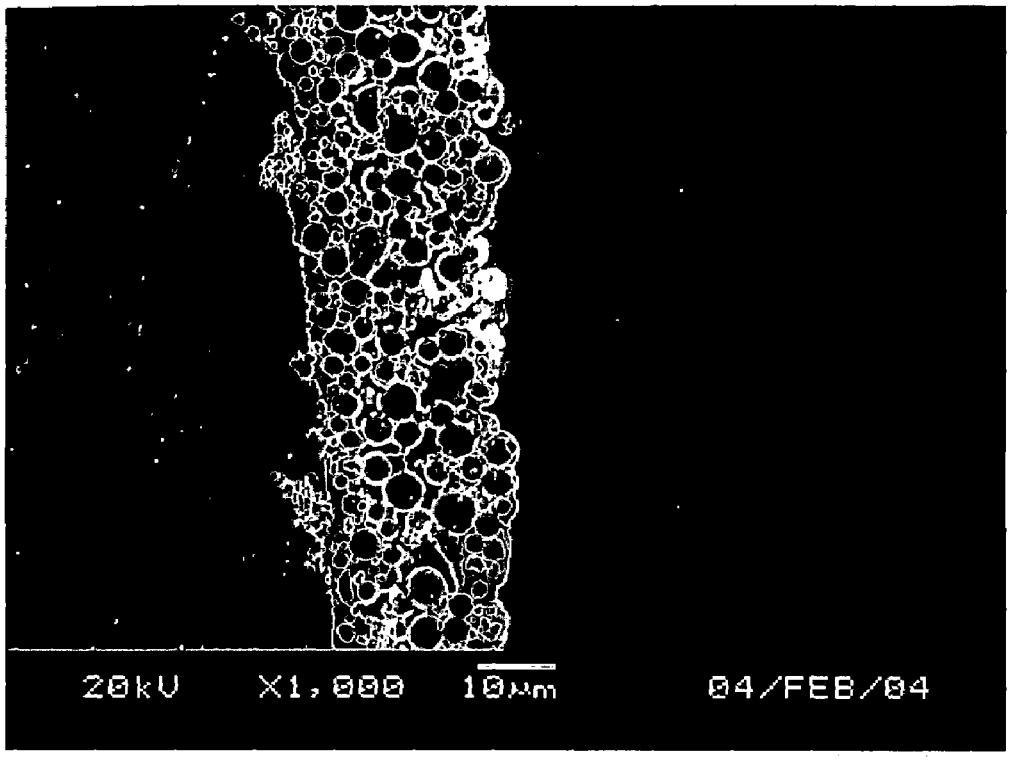
FIGS. 7A-B are SEM images of a composite coating formed on the substrate surface at magnifications of 1,000× and 3,000×, respectively.
Figure 7B:
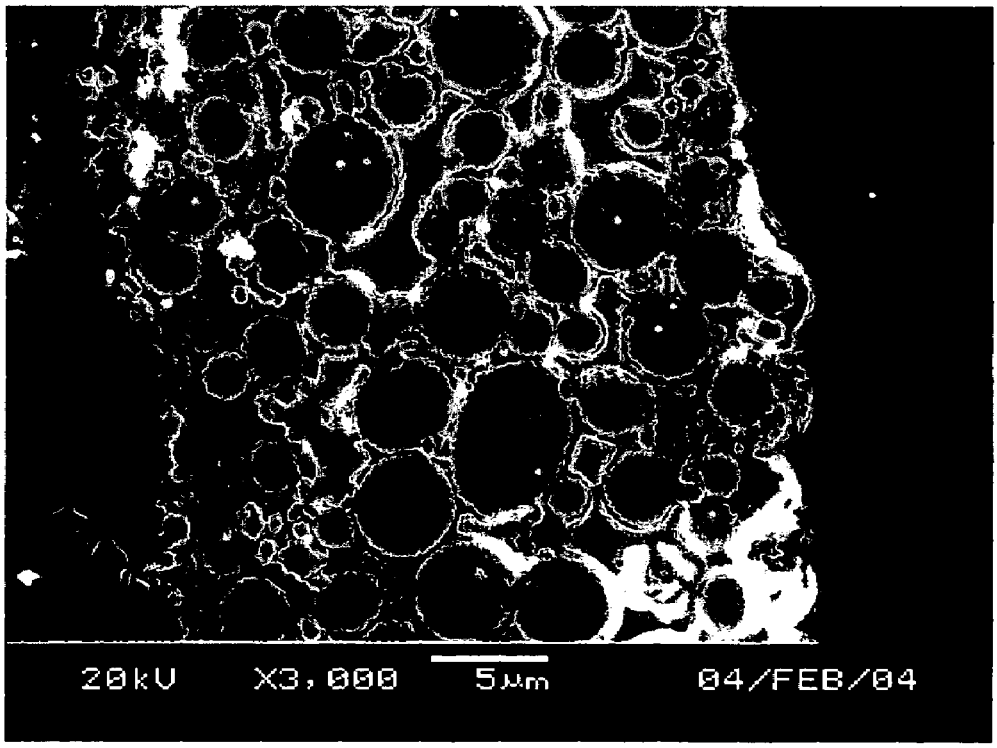

Electrocodepositon of a Composite Coating Incorporating a Quasicrystalline Metal Alloy Material and Nickel Metal and Including the Use of a "Seal" Bath A substrate having the dimensions 2 inches by 1 inch by 0.03 inches thick made of alloy 3004 aluminum was prepared in substantially the same manner as described in Example 1, except that the solution had a pH of 4.4 and a temperature of 36° C., the electrocodeposition occurred under a current of 450 mA (6 V) applied for 100 minutes, and the nickel seal occurred under a current of 450 mA for 10 minutes. The resulting composite coating and substrate were cut to expose a cross-section. FIGS. 7A-B are SEM images of the composite coating formed on the substrate surface at magnifications of 1,000× and 3,000×, respectively. The images clearly show the particles of the quasicrystalline metal alloy in a nickel matrix.

The terms "electroless deposition" or "electroless plating", as used herein, refer to methods of plating conductive substrates with copper, nickel, cobalt or similar metals without the use of an external source of electric current. In general, electroless plating is characterized by the selective reduction of metal ions only at the surface of a substrate immersed in an aqueous solution of the metal ions, with continued deposition on the substrate through the catalytic action of the deposit itself. Examples of reducing agents suitable for use in electroless deposition processes include sodium hypophosphite, sodium borohydride, dimethyl borane and hydrazine.

The term "electroplating", as used herein, is defined as the electrodeposition of an adherent metallic coating upon a substrate for the purpose of securing a surface with properties or dimensions different from those of the base metal. The physical embodiment of an electroplating process consists of four parts: (1) the external circuit, consisting of a source of direct current (dc), means of conveying this current to the plating tank, and associated instruments such as ammeters, voltmeters, and means of regulating the voltage and current to their appropriate values; (2) the negative electrode or cathode, which is the material to be plated is called the working electrode, along with means of positioning the work in the plating solution so that contact is made with the current source; (3) the plating solution itself, almost always aqueous, which is sometimes referred to as the "bath"; (4) the positive electrode, the anode, usually the metal being plated but sometimes of a conducting material which serves merely to complete the circuit, called an inert or counter electrode.

For example, in nickel electroplating, $Ni^{+2}$ ions accept electrons according to the following reaction and deposit on the cathode as nickel atoms:

$$Ni^{+2}+2e^{-}\rightarrow Ni^{0}$$

The corresponding reaction at the anode or the counter electrode, can be expressed by the following reaction:

$$4OH^{-}\rightarrow 2H_2O+O_2+4e^{-}$$

The terms "composite plating" or "electrocodeposition" refers to processes in which particles are held in suspension in a plating bath and codeposited with a metal during deposition. The particles used are inert to the bath and can be of different types, that is, pure metals, alloys, ceramics, or organic materials. On combining this variety of particles with different electrodeposited metals, electrochemical codeposition enables the production of a large range of composite materials with unique properties. Codeposition of solid particles with a metal to obtain a composite coating involves two adsorption processes. First, metal ions are adsorbed on the surfaces of the particles; second, solid particles, after reaching the cathode, undergo adsorption. It is believed that the metal ions are adsorbed on a solid particle to enable its codeposition with a metal. Finally, charge transfer occurs at the cathode surface during codeposition causing the electrochemical reduction of adsorbed metal ions on the cathode, creating a real contact between particles and cathode.

The terms "particle" or "particles" as used herein include grain and powders and no exact size limitation or range is intended except as specifically stated.

The terms "comprising," "containing," "including," and "having," as used in the claims and specification herein, shall be considered as indicating an open group that may include other elements not specified. The term "consisting essentially of," as used in the claims and specification herein, shall be considered as indicating a partially open group that may include other elements not specified, so long as those other elements do not materially alter the basic and novel characteristics of the claimed invention. The terms "a," "an," and the singular forms of words shall be taken to include the plural form of the same words, such that the terms mean that one or more of something is provided. For example, the phrase "a disk comprising a rib" should be read to describe a disk having one or more ribs. The term "one" or "single" shall be used to indicate that one and only one of something is intended. Similarly, other specific integer values, such as "two," are used when a specific number of things is intended. The terms "preferably," "preferred," "prefer," "optionally," "may," and similar terms are used to indicate that an item, condition or step being referred to is an optional (not required) feature of the invention.

It should be understood from the foregoing description that various modifications and changes may be made in the preferred embodiments of the present invention without departing from its true spirit. It is intended that this foregoing description is for purposes of illustration only and should not be construed in a limiting sense. Only the language of the following claims should limit the scope of this invention.

What is claimed is:

1. A method, comprising:

electrocodepositing particles of at least one quasicrystalline metal alloy and at least one elemental metal onto a working electrode disposed in an electroplating bath using short-cycle ramping of a DC current, wherein the electroplating bath comprises a solvent, ions of the at least one elemental metal dissolved in the solvent, and the particles of at least one quasicrystalline metal alloy suspended in the solvent.

2. The method of claim 1, wherein the working electrode has an electronically conducting surface.

3. The method of claim 2, wherein the electronically conducting surface comprises a material selected from metals, alloys, graphite, carbon-carbon composites, and combinations thereof.

4. The method of claim 2, further comprising:

maintaining the electroplating bath at a pH between 2 and 7.

5. The method of claim 4, further comprising:

adding aqueous $K_2CO_3$ or $H_2SO_4$ to the bath to maintain the pH.

6. The method of claim 2, further comprising:
maintaining the temperature of the electroplating bath during electrocodeposition between 10 and 70° C.

7. The method of claim 2, further comprising:
agitating the electrolyte solution.

8. The method of claim 1, wherein the at least one elemental metal is selected from manganese, iron, cobalt, chromium, nickel, copper, zinc, and combinations thereof.

9. The method of claim 1, wherein the electroplating bath is selected from an electrolytic deposition bath, an electroless deposition bath, and mixtures thereof.

10. The method of claim 1, wherein the electroplating bath is suitable for plating the at least one elemental metal, wherein the at least one elemental metal is selected from nickel, copper, and combinations thereof.

11. The method of claim 1, wherein the temperature of the electroplating bath during the electrocodeposition does not exceed the melting point of the particles of the at least one quasicrystalline metal alloy or the melting point of the working electrode.

12. The method of claim 1, wherein the temperature of the electrocodeposition bath during the electrocodeposition does not exceed 100° C.

13. The method of claim 1, wherein the at least one quasicrystalline metal alloys include aluminum-transition metal alloys.

14. The method of claim 13, wherein the aluminum-transition metal alloys are selected from Al—Cu-M, Al—Pd-M and combinations thereof, where M is a transition metal selected from Fe, Ru, Ni, Mn, Cr, Co and combinations thereof.

15. The method of claim 13, wherein the quasicrystals are ternary, quaternary and higher alloys.

16. The method of claim 15, further comprising:
providing a counter electrode comprising iron, cobalt, nickel, copper, zinc, platinized titanium, or ruthenium/iridium oxide-coated titanium metal, or a combination thereof.

17. The method of claim 13, wherein the quasicrystals include up to about 10 atomic percent of a transition metal selected from Ti, V, Cr, Mn, Co, Ni, Ta, W, Nb, Mo, Zr and combinations thereof.

18. The method of claim 13, wherein the quasicrystals include B, Si or combinations thereof.

19. The method of claim 1, wherein the electroplating bath comprises between 25 and 150 grams of quasicrystalline metal alloy particles per liter of the electroplating bath.

20. The method of claim 1, wherein the working electrode is a substrate selected from copper, aluminum, an alloy of aluminum, carbon or graphite, cast iron, wrought iron, carbon steels, stainless steels, copper/tin alloys, copper/zinc alloys, copper/nickel alloys, doped or undoped semiconductors, polymer/carbon composites, polymer/graphite composites, polymer/metal composites, and metal/metal composites.

21. The method of claim 1, wherein the working electrode is selected from polymers and polymer composites.

22. The method of claim 21, wherein the working electrode is a polymer composite comprising carbon or metal.

23. The method of claim 1, further comprising:
applying an electroless or electrolytic strike on the working electrode prior to the electrocodepositing step, wherein the strike comprises a metal selected from zinc, nickel, copper, platinum, cobalt, gold and combinations thereof.

24. The method of claim 23, wherein the working electrode is an aluminum alloy 3004 substrate, and the strike includes electroless zincate followed by electroless copper.

25. The method of claim 1, wherein the electroplating bath is aqueous.

26. The method of claim 25, wherein the at least one elemental metal is selected from chromium, manganese, iron, cobalt, nickel, copper, zinc, and combinations thereof.

27. The method of claim 26, wherein the concentration of the metal ions in the electroplating bath is between 500 and 20,000 ppm.

28. The method of claim 1, wherein the dissolved metal ions are in the form of a metal sulfate, metal sulfamate, metal citrate, metal chloride, metal bromide, metal nitrate, or combinations thereof.

29. The method of claim 1, wherein the electroplating bath comprises aqueous nickel sulfate.

30. The method of claim 29, wherein the electroplating bath comprises between 2 and 12 grams of nickel sulfate per liter of the electroplating bath.

31. The method of claim 1, wherein the electroplating bath further comprises a reducing agent, a buffering agent, or a combination thereof.

32. The method of claim 1, wherein the electroplating bath further comprises a buffering agent selected from hypophosphite, formaldehyde, acetate, citrate, boric acid, and combinations thereof.

33. The method of claim 1, further comprising:
agitating the electroplating bath to suspend the quasicrystalline metal alloy particles.

34. The method of claim 33, wherein the electroplating bath comprises between 25 and 150 grams of suspended quasicrystalline metal alloy particles per liter of electroplating bath.

35. The method of claim 1, wherein the quasicrystalline metal alloy particles have an average particle size less than 50 microns.

36. The method of claim 1, wherein the quasicrystalline metal alloy particles have an average particle size less than 20 microns.

37. The method of claim 1, wherein the at least one quasicrystalline metal alloy is selected from $Al_{65}Cu_{25}Fe_{12}$, $Al_{66}Cu_{18}Fe_8Cr_8$, $Al_{59}Cu_{25.5}Fe_{12.5}B_3$, $Al_{64}Cu_{18}Fe_8Cr_8$, and combinations thereof.

38. The method of claim 1, wherein the working electrode is electronically conductive.

39. The method of claim 1, further comprising:
moving at least one electrode during the electrocodeposition.

40. The method of claim 1, further comprising:
electroplating a metal seal layer over a layer comprising the electrocodeposited quasicrystalline metal alloy particles.

41. The method of claim 40, wherein the metal seal layer is electroplated in a separate seal bath.

42. The method of claim 1, further comprising:
repeatedly ramping the DC current between essentially zero current and a target current density.

43. The method of claim 42, wherein the target current density is between 2 and 100 $mA/cm^2$.

44. The method of claim 42, wherein the target current density is about 40 $mA/cm^2$.

45. The method of claim 42, wherein the ramping occurs in cycles between $10^{-2}$ and $10^5$ Hertz.

46. The method of claim 1, wherein the at least one quasicrystalline metal alloy is $Al_{65}Cu_{23}Fe_{12}$.

47. The method of claim 1, wherein the at least one quasicrystalline metal alloy is $Al_{70}Cu_{10}Fe_{10}Cr_{10}$.

48. The method of claim 1, wherein the ions of the at least one elemental metal include nickel ions.

49. The method of claim 48, wherein the nickel ion concentration is between 2 and 10 grams per liter of electroplating bath.

50. The method of claim 1, wherein the at least one elemental metal includes copper.

51. The method of claim 1, further comprising:

simultaneously performing the electrocodepositing step on multiple working electrodes in the same electroplating bath.

52. The method of claim 1, further comprising:

annealing the particles of the at least one quasicrystalline metal alloy.

53. The method of claim 52, wherein the at least one quasicrystalline metal alloy is converted from the beta-phase to the quasicrystalline phase.

54. The method of claim 52, wherein the annealing is performed prior to electrocodepositing the particles.

55. The method of claim 52, wherein the annealing is performed after electrocodepositing the particles.

56. The method of claim 52, wherein the annealing is performed before and after electrocodepositing the particles.

57. The method of claim 52, wherein the at least one quasicrystalline metal alloy is annealed at a temperature between 500 and 700° C.

58. The method of claim 52, characterized in that the annealing increases the ratio of quasicrystalline phase in the particles.

59. The method of claim 52, wherein the annealing is performed under an inert gas atmosphere.

60. The method of claim 1, further comprising:

masking a portion of the working electrode to prevent electrocodeposition.

61. The method of claim 1, wherein the electroplating bath contains copper sulfate.

62. The method of claim 61, wherein the copper sulfate has a concentration between 0.1 and 0.6 grams of copper per liter of the bath.

63. The method of claim 1, further comprising a preliminary step selected from bead blasting the surface of the substrate, degreasing the substrate prior to electrocodepositing, and combinations thereof.

64. The method of claim 1, wherein the electroplating bath further comprises other metal alloy particles.

65. The method of claim 64, wherein the electroplating bath further comprises other metal alloy particles that are not quasicrystalline metal alloys.

66. The method of claim 1, wherein the particles of at least one quasicrystalline metal alloy are provided as a mixture of quasicrystalline metal alloy particles with other metal alloy particles having different compositions.

67. The method of claim 66, further comprising:

depositing a composite coating comprising the mixture of alloy particles suspended in the electroplating bath.

68. A method, comprising:

electrocodepositing particles of at least one quasicrystalline metal alloy and at least one elemental metal onto a working electrode disposed in an electroplating bath, wherein the electroplating bath comprises a solvent, ions of the at least one elemental metal dissolved in the solvent, and the particles of at least one quasicrystalline metal alloy suspended in the solvent;

electroplating a metal seal layer over a layer comprising the electrocodeposited quasicrystalline metal alloy particles, wherein the metal seal layer is electroplated in a separate seal bath; and alternating the use of the seal bath and the electroplating bath containing the suspended particles of a quasicrystalline metal alloy.

69. The method of claim 68, further comprising:

repeating the alternating use of the baths until a desired coating thickness is obtained.

* * * * *